United States Patent [19]

Megerle

[11] 4,412,583

[45] Nov. 1, 1983

[54] APPARATUS AND METHODS FOR COOLING EXHAUST GAS STREAMS CONTAINING SUSPENDED PARTICLES

[75] Inventor: Friedrich Megerle, Cologne, Fed. Rep. of Germany

[73] Assignee: Klöckner-Humboldt-Deutz AG, Fed. Rep. of Germany

[21] Appl. No.: 202,483

[22] Filed: Oct. 31, 1980

[30] Foreign Application Priority Data

Nov. 5, 1979 [DE] Fed. Rep. of Germany ..... 2944581

[51] Int. Cl.[3] ..... F28G 3/12; F28G 7/00

[52] U.S. Cl. ..... 165/95; 432/2

[58] Field of Search ..... 122/44 A, 155 H, 397; 165/94, 84; 15/104.07, 104.04; 266/155 A; 34/13, 141

[56] References Cited

FOREIGN PATENT DOCUMENTS 2345721 3/1975 Fed. Rep. of Germany ..... 165/95

2030672 4/1980 United Kingdom ..... 165/95

554463 5/1977 U.S.S.R. ..... 165/84

*Primary Examiner*—William R. Cline

*Assistant Examiner*—Theophil W. Streule, Jr.

*Attorney, Agent, or Firm*—Hill, Van Santen, Steadman & Simpson

[57] ABSTRACT

Method and apparatus for cooling a hot gas stream containing suspended finely divided particles wherein a cooling fluid is circulated through confined cooling elements located in a large flow housing, the gas stream to be cooled passing exteriorly of the cooling elements in countercurrent heat exchange relationship therewith. The cooling fluid is circulated through the cooling elements in a confined path and cleaning means are provided inside the cooling elements which are arranged to impact the cooling elements periodically to thereby dislodge particles adhering to the exterior surfaces of such cooling elements.

2 Claims, 3 Drawing Figures

APPARATUS AND METHODS FOR COOLING EXHAUST GAS STREAMS CONTAINING SUSPENDED PARTICLES

BACKGROUND OF THE INVENTION

1. Field of the Invention

This invention is in the field of coolers for cooling hot gas streams wherein cleaning elements are disposed in the circulating stream of cooling agent rather than in the particle laden hot gas stream.

2. Description of the Prior Art

In a known type of gas cooler, there is provided a perpendicular bundle of parallel pipes arranged at intervals from one another, the bundle being disposed within a large flow housing. The dust-laden gas stream to be cooled flows within the pipes and cooling air flows through the large flow housing outside of the pipes. On the dust-laden gas side of the pipe there is provided a device for cleaning the cooling surfaces of solid material which adheres thereto. The cleaning device usually consists of steel tapes freely suspended within each pipe, the steel tapes being driven by means of a rotary drive at their points of suspension. When the steel tapes are rotated, they scrape adhering solid material off the inside wall of the pipes.

This type of cleaning device does not have a very long useful life because it is exposed to hot gases which are very corrosive, particularly when they contain a high sulfur dioxide content.

When a known gas cooler of this type is put in place directly on the exhaust gas stack disposed above a metal smelting chamber, the danger exists that steel tapes of the cleaning device are attacked by the exhaust gases, and fall into the smelt. The cooling pipes then accumulate large amounts of solid material so that the heat transfer is substantially reduced.

SUMMARY OF THE INVENTION

The present invention avoids the disadvantages of the prior art and provides a gas cooler which functions reliably even when cooling very hot and corrosive gases. In accordance with the present invention, the cleaning device is disposed within the stream of cooling gas rather than outside the cooling elements on the hot gas side. In accordance with the present invention, the small flow channels are used for circulating the cooling agent, such as cooling air, and the large flow housing confines the gas stream to be cooled, which stream flows around the bundle of cooling elements from the outside. In so doing, the cleaning device is not exposed to the hot, corrosive gases. The cleaning device preferably takes the form of a suspended beater which cannot become detached and fall into a smelting chamber because it is not positioned within the dust-laden side of the cooling surfaces. Consequently, the gas cooler of the present invention works very reliably.

BRIEF DESCRIPTION OF THE DRAWINGS

A further description of the present invention will be made in conjunction with the attached sheets of drawings in which.

DESCRIPTION OF THE PREFERRED EMBODIMENTS

Figure 1:
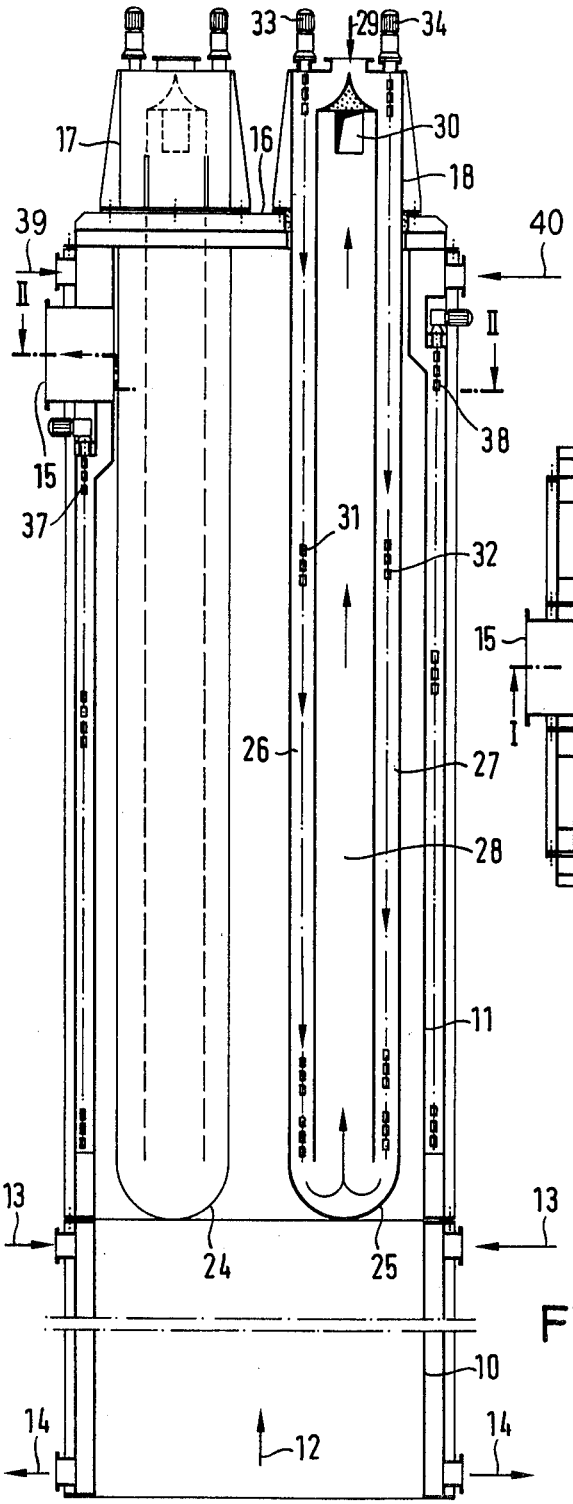
FIG. 1 is a vertical sectional view through a gas cooler according to the present invention taken along the line I—I of FIG. 2.

Referring to the drawings, the gas cooler of the present invention has a vertical flow housing 10 including spaced outer walls 11 of rectangular cross section. The housing 10, 11, for example, is placed directly over an exhaust gas shaft which is disposed vertically above a metal smelting chamber of the type used, for example, for smelting non-ferrous ore concentrates. In the flash smelting of sulfidic ore concentrates in an oxygen-rich atmosphere, for example, a dust-laden exhaust gas stream is produced at a temperature of about 1050° C., with approximately the following composition:

46.4% $SO_2$
28.7% $CO_2$
11.3% $H_2O$
4.2% $O_2$
9.4% $N_2$

This hot, dust-laden corrosive gas stream enters from below as indicated by the arrow 12 into the flow housing 10 and may be cooled to about 750° C. in passing through the lower end of the housing. The entry of cold air into the housing 11 is shown by arrows 13, and the discharge of this heated cooling air is indicated by arrows 14. An exhaust gas cooled to approximately 500° C. leaves the gas cooler through a lateral nozzle 15 arranged at the upper side of the housing and then may be delivered to an electrostatic dust separator or the like for cleansing the gas.

A plurality of vertical, rectangular box-shaped cooling elements 17 through 23 are secured in depending relation to an upper terminating wall 16 of the flow housing 11, the cooling elements extending freely down into the gas stream to be cooled. Cooling elements 17 through 23 are closed at their lower ends by means of arcuate closures 24, 25. Using cooling element 18 as an example, it will be seen from FIGS. 1 and 2 that the cooling elements consist of a housing having a rectangular cross section consisting of outer passages 26 and 27 each having a rectangular cross section, but preferably not a square cross section. These passages are disposed opposite one another so that the cooling air flows down the passages 26 and 27 initially in countercurrent heat transfer relationship with the hot gases flowing around the cooling elements, and finally flows upwardly in concurrent heat transfer relationship through a centrally disposed passage 28 located between the outer passages 26 and 27. The cold cooling air, as indicated by arrow 29, enters the cooling passages 26, 27 which are open toward the top at the top of the housing and is directed toward the bottom in, eventually reversing direction and passing into the cooling air return passage 28. This cooling air leaves the cooling air return box 28 at the top through a lateral discharge aperture 30 at a temperature of approximately 110°to 115° C.

Cleaning devices are provided within the cooling elements which may take the form of beating devices 31, 32 extending in depending relation within each cooling element 17 through 23 in passages 26 and 27, respectively. Such beating device may consist, for example, of a link chain which is connected to a rotary drive such as an electric motor, 33 or 34, at its point of suspension. The cleansing action is based on the effect that freely suspended link chains when placed into rotation assume a sinusoidal wave form wherein the wave amplitude becomes greater or less depending on the speed of rotation. Due to the rectangular, non-square cross section of the cooling air passages 26, 27, the formation of the wave form in the direction of the narrow side of the rectangle is promoted. The chain amplitude vibration is impeded when it strikes the long side of the rectangle, thus impacting against the cooling element and causing vibration or concussion of the entire walls of the cooling elements 17 through 23. A plurality of waves which all add to the vibration of the cooling elements to various degrees are formed over the entire length of the chain. With this type of impacting, the solid material deposited on the opposite side of the cooling surfaces on the cooling elements is periodically shaken off. This dislodged material falls back into the smelting chamber or is transported to a gas cleaning system together with the cooled gas stream.

Figure 2:
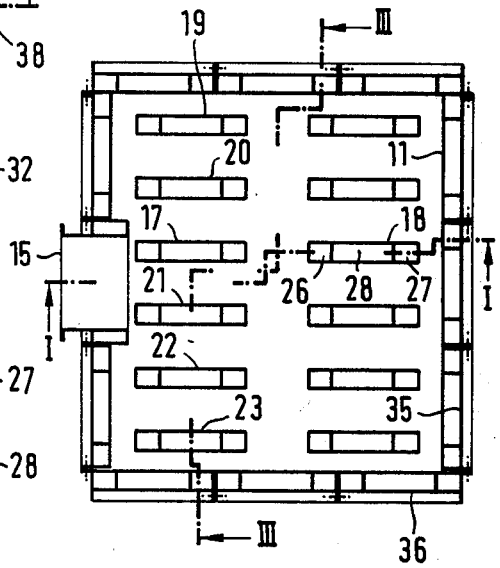
FIG. 2 is a horizontal cross-sectional view taken substantially along the line II—II of FIG. 1.
Figure 3:
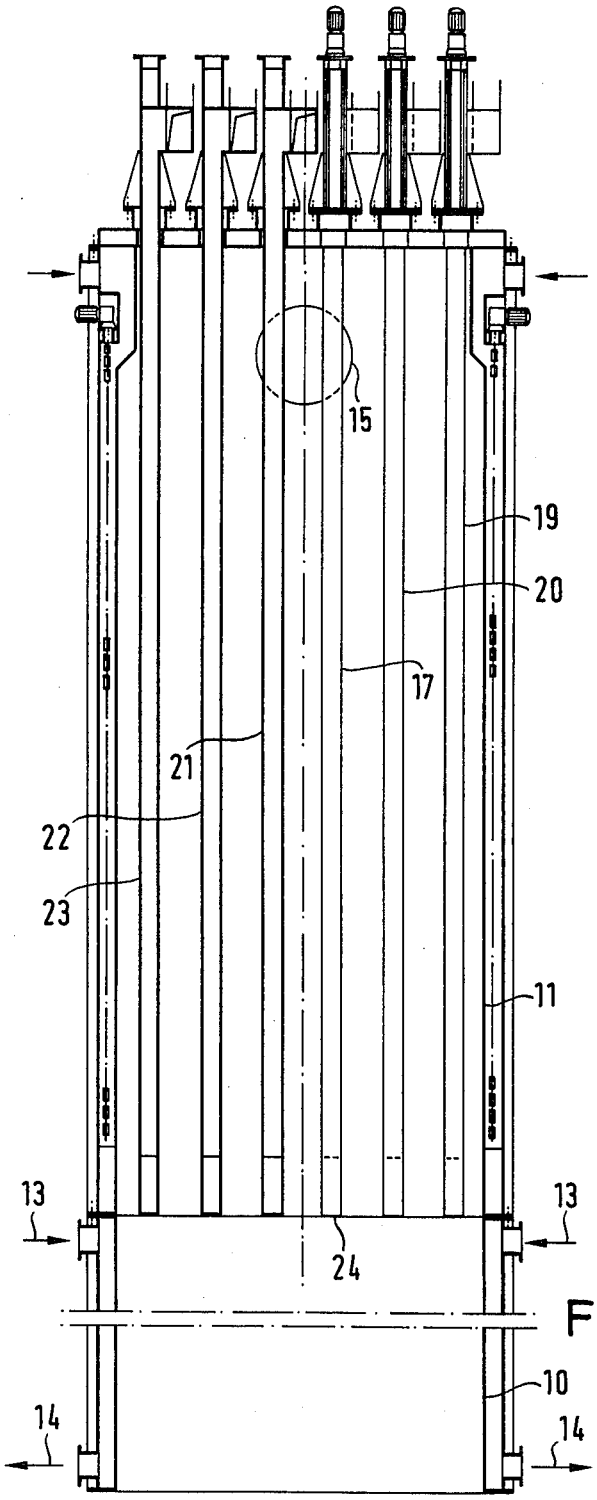
FIG. 3 is a vertical cross-sectional view taken substantially along the line III—III of FIG. 2.

As will be seen particularly from FIG. 2, the outside walls of the flow housing 11 for the gas stream to be cooled also consist of box-shaped rectangular cooling elements 35 and 36 which, like the cooling elements in the interior portion of the cooler, can be composed of two cooling air passages lying at the outside, and a cooling air return box disposed between them. Link chains 37, 38 are likewise disposed in the cooling air passages of the outside wall of the housing, and the link chains when rotated place the entire inside wall of the flow housing 11 in vibration and produce the cleansing of adhering solids material. The entry of cold cooling air into such cooling air passages lying in the housing 11 is indicated by arrows 39, 40.

It will be understood that the suspended link chains 31, 32, 37, 38 and the like instead of being connected to a separate drive motor can also be connected to a central, common drive system which can consist, for example, of a drive chain which engages separate chain sprockets. Instead of link chains, other elements can also be suspended which cause a wave formation when they are rotated, and which deflect toward the side.

The gas cooler of the present invention is particularly suited for cooling hot exhaust gases which are highly corrosive due to a high sulfur dioxide content. Such exhaust gases would be diluted in an undesirable manner when cooled with a spray cooling device involving direct injection of water when the exhaust gases are employed for subsequent production of sulfuric acid. With an indirect water cooling of such exhaust gases, the cooling surfaces would be too cold and the sulfur dioxide would have a highly corrosive effect on the cooling surfaces.

It should be evident that various modifications can be made to the described embodiments without departing from the scope of the present invention.

I claim as my invention:

1. A cooler for cooling a hot gas stream containing suspended finely divided particles comprising:

a large flow housing, means for introducing said hot gas stream at the base of said large flow housing, a plurality of fluid circulating tubular cooling elements of rectangular cross section supported in said flow housing with their major axes vertical and means defining inner and outer passages of substantially rectangular cross-section, said cooling elements being supported in depending relation within said large flow housing and having closed lower ends, means for circulating a cooling fluid through said cooling elements into heat exchange relationship with said hot gas stream surrounding said cooling elements, said hot gas stream being passed through a substantially larger cross-sectional area than occupied by said cooling elements, and cleaning means including freely oscillatable free-hanging devices positioned and located inside said cooling elements and in said outer passages in depending relation terminating short of said closed lower ends and arranged to impact said cooling elements to dislodge particles adhering externally thereto, and rotary drive means for rotating said cleaning elements within said cooling elements.

2. A cooler according to claim 1 in which: said large flow housing has outer walls having rectangular cooling passages formed therein for further cooling said hot gas stream.

* * * * *